US009737820B2

(12) United States Patent
Cai

(10) Patent No.: US 9,737,820 B2
(45) Date of Patent: Aug. 22, 2017

(54) TOY GYRO HAVING GYRO RING THAT CAN BE ASSEMBLED AT BOTH SIDES

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation & Culture Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 0 days.

(21) Appl. No.: 14/784,447

(22) PCT Filed: Apr. 7, 2015

(86) PCT No.: PCT/CN2015/075937
§ 371 (c)(1),
(2) Date: Oct. 14, 2015

(87) PCT Pub. No.: WO2016/026304
PCT Pub. Date: Feb. 25, 2016

(65) Prior Publication Data

US 2016/0220912 A1 Aug. 4, 2016

(30) Foreign Application Priority Data

Aug. 16, 2014 (CN) ..... 2014 1 0402506

(51) Int. Cl.
*A63H 1/00* (2006.01)
*A63H 1/02* (2006.01)
(Continued)

(52) U.S. Cl.
CPC ..... *A63H 1/02* (2013.01); *A63H 1/00* (2013.01); *A63H 1/06* (2013.01); *A63H 1/18* (2013.01)

(58) Field of Classification Search
CPC ... A63H 1/00; A63H 1/02; A63H 1/04; A63H 1/18; A63H 1/28
(Continued)

(56) References Cited

U.S. PATENT DOCUMENTS 461,948 A * 10/1891 Wilson ..... A63H 1/30 446/250
D155,015 S * 8/1949 Krapp ..... 102/359
(Continued)

FOREIGN PATENT DOCUMENTS

AU 2012344547 A 7/2014
CN 2392579 Y 8/2000
(Continued)

OTHER PUBLICATIONS

Machine Translation of CN202983179U1.*
(Continued)

*Primary Examiner* — Aarti B Berdichevsky
*Assistant Examiner* — Urszula M Cegielnik
(74) *Attorney, Agent, or Firm* — Lerner, David, Littenberg, Krumholz & Mentlik, LLP

(57) ABSTRACT

A toy gyro has a gyro ring that can be assembled at both sides and includes an axis body, gyro ring, tip and cover that are disposed on the axis body. A direction of mounting the gyro ring on the axis body may be turned over vertically, so that by turning over vertical orientations of the gyro ring on the axis body, gyros having different shapes or different heights of center of gravity may be formed. In other words, the gyro ring may be mounted on the axis body with a front side facing upwards, or the gyro ring may be mounted on the
(Continued)

axis body with a reverse side facing upwards, so that during playing of the present invention, gyros having different shapes or having different heights of center of gravity may be formed by assembling of the gyro ring on the axis body in different directions.

10 Claims, 4 Drawing Sheets

(51) Int. Cl.
*A63H 1/06* (2006.01)
*A63H 1/18* (2006.01)

(58) Field of Classification Search
USPC ..... D21/460
See application file for complete search history.

(56) References Cited

U.S. PATENT DOCUMENTS 2,991,584 A * 7/1961 Kaufman ..... A63H 1/00 446/235
4,207,701 A * 6/1980 Kuhn ..... A63H 1/30 446/250
4,555,235 A * 11/1985 Burroughs ..... A63H 1/22 446/243
5,017,172 A * 5/1991 Seifert ..... A63H 1/30 446/250
5,032,101 A * 7/1991 Hartman ..... A63H 1/08 446/235
D356,347 S * 3/1995 Nonaka ..... D21/460
6,142,850 A * 11/2000 Levy ..... A63H 1/30 446/250
6,146,233 A * 11/2000 Hedeen, Jr. ..... A63H 1/04 446/247
6,520,827 B1 2/2003 Liu
6,604,979 B1 * 8/2003 Liu ..... A63H 1/02 446/256
D615,134 S * 5/2010 Nishimoto ..... D21/460
D615,602 S * 5/2010 Nishimoto ..... D21/460
D665,858 S * 8/2012 Horikoshi ..... D21/460
8,328,595 B2 * 12/2012 Van Dan Elzen ..... A63H 1/30 446/247
8,968,049 B2 * 3/2015 Hasegawa ..... A63H 1/30 446/250
2002/0102907 A1 * 8/2002 Osawa ..... A63H 1/00 446/256
2005/0233674 A1 * 10/2005 Torres ..... A63H 1/02 446/236
2009/0253344 A1 * 10/2009 Ujita ..... A63H 1/02 446/256
2010/0317254 A1 * 12/2010 Van Dan Elzen ..... A63H 1/30 446/250
2011/0009029 A1 * 1/2011 Van Dan Elzen ..... A63H 1/30 446/250
2013/0109269 A1 * 5/2013 Hasegawa ..... A63H 1/30 446/250
2013/0225036 A1 * 8/2013 Kaye ..... A63H 1/00 446/233

FOREIGN PATENT DOCUMENTS

CN 202315281 U 7/2012
CN 202822752 U 3/2013
CN 202983179 U 6/2013
CN 103585763 A 2/2014
CN 204073390 U 1/2015
JP S502500 1/1975
JP 3067318 U * 3/2000
JP 3083443 U 1/2002
JP 3149384 U 3/2009
JP 2011206509 A 10/2011
KR 20030059008 A 7/2003
KR 20060081384 A 7/2006

OTHER PUBLICATIONS

Machine Translation of JP3067318U.*
International Search Report for Application No. PCT/CN2015/075937 dated Jun. 25, 2015.
Australian Patent Application No. 2015230819 Examination Report No. 1, dated Jun. 7, 2016.
Australian Patent Application No. 2015230819 Examination Report No. 2, dated Aug. 16, 2016.
European Search Report for Application No. 15766041.6 dated Jan. 11, 2017.

* cited by examiner

TOY GYRO HAVING GYRO RING THAT CAN BE ASSEMBLED AT BOTH SIDES

CROSS-REFERENCE TO RELATED APPLICATIONS

The present application is a national phase entry under 35 U.S.C §371 of International Application No. PCT/CN2015/075937 filed Apr. 7, 2015, which claims priority from Chinese Application No. 201410402506.5 filed Aug. 16, 2014, all of which are hereby incorporated herein by reference.

TECHNICAL FIELD

The present invention relates to the field of toy, and in particular, to a toy gyro having a gyro ring that can be assembled at both sides.

BACKGROUND

A conventional toy gyro is basically formed by an axis, a cover, a gyro ring and a tip, and a gyro ejector is connected to the cover and ejects the gyro out for rotation. Because there is merely one mounting manner for the gyro ring and the axis body of the conventional gyro, that is, mounting can only be performed in a unified direction, and cannot be turned over, the gyro is in merely one shape and can implement merely one attack mode, the game mode is single and has little interestingness, so that such a gyro gradually loses novelty and has difficulty getting the favor of players for a long time.

SUMMARY

An objective of the present invention is, directed to the above mentioned problems and defects, providing a toy gyro having a gyro ring that can be assembled at both sides, the gyro has a variable assembling manner, and a user can freely select different manners for assembling according to characteristics of gyros of opponents, so as to implement attack modes in different shapes or different centers of gravity, the game mode is diversified, the structure is simple and the mounting is easy.

The technical solution of the present invention is implemented as follows:

A toy gyro having a gyro ring that can be assembled at both sides according to the present invention includes an axis body, and a gyro ring, a tip and a cover that are disposed on the axis body, characterized in that a direction of mounting the gyro ring on the axis body may be turned over vertically, so that by turning over vertical orientations of the gyro ring on the axis body, gyros having different shapes or different heights of center of gravity may be formed.

In order that the gyro ring will not be separated from the axis body when the cover is removed and that the mounting is more convenient when the gyro ring is turned over and connected to the axis body, the gyro ring may be provided with a locking structure fitting the axis body, and the gyro ring is reliably connection to the axis body by means of the locking structure.

In order that in the present invention gyros having obviously different shapes and centers of gravity can be formed after the direction of the gyro ring is turned over, the structural shapes or center of gravity settings of the upper and lower sides of the gyro ring are different; or the locking structure is disposed at a non-middle height position of the gyro ring, so as to change the height of the center of gravity of the gyro before and after the turnover, this is especially suitable for a case that the structural shapes or center of gravity settings of the upper and lower sides of the gyro rings are the same. This is because the variation of the height of the center of gravity of the gyro is mainly influenced by: first, the height of design positions of a connection structure (locking structure) for connecting the gyro ring and the axis body; second, different centers of gravity of two sides due to structural differences between upper and lower sides of the gyro ring, so that the gyro formed after the gyro ring direction is turned over has a different overall shape and overall center of gravity from the original gyro.

In order that the gyro ring has a greater rotational inertia and that it is more convenient to closely fit and assemble the gyro ring and the axis body, the gyro ring includes an attack ring having a through hole in the middle, and a screw ring disposed fitting the through hole of the attack ring and used for implementing reliable connection of the attack ring and the axis body, and the locking structure is disposed on the screw ring. The attack ring is generally made of metal, and the screw ring is made of non-metallic material, such as plastomer or plastics. There is a circular hole in the middle of the attack ring, without any structure such as an integrally disposed connection hole and assistant radial ribs connected to the connection hole, so that the material and processing process of the attack ring is reduced, and more development space is left for the gyro; moreover, the major center of gravity of the attack ring having a large weight lies in the outer part, so the rotational inertia is large. In addition, the locking structure in the screw ring is directly used to lock the gyro ring to the axis body, so that when the cover is removed, the gyro ring is not separated from the axis body, and therefore, it may be conveniently used in a combined toy gyro.

Further, in order to form gyros having obviously different shapes and centers of gravity after the gyro ring is turned over, and in order that the appearance is more beautiful and the structure is more reliable, the screw ring includes upper and lower cover rings disposed fitting the through hole of the attack ring, the locking structure includes upper and lower flanges correspondingly disposed on inner walls of the upper and lower cover rings; when the axis body is sleeved in ring holes of the upper and lower cover rings, the upper and lower cover rings implement the reliable connection with the axis body by means of fitting and catching of the upper and lower flanges and a block structure disposed on the axis body. The upper and lower cover rings generally adopt mounting rings having different shapes or center of gravity settings.

In the present invention, a structure in which the direction of mounting the gyro ring on the axis body may be turned over vertically is adopted, in other words, the gyro ring may be mounted on the axis body with an upper side (a front side) facing upwards, or the gyro ring may be mounted on the axis body with a lower side (a reverse side) facing upwards, so that during playing of the present invention, gyros having different shapes or having different heights of center of gravity may be formed by assembling of the gyro ring on the axis body in different directions, for example, when the center of gravity is low, the gyro has a strong endurance; and when the center of gravity is high, the gyro can perform top attack, and therefore, embodied functions are different, so that a user can select a different manner according to a characteristic of a gyro of an opponent, the game mode is more diversified, thereby effectively solving the problems of the conventional gyro such as single structure and game mode and little interestingness. Moreover, the locking structure disposed on the gyro ring and can be fit and clamped with the axis body is used in the present invention, when the cover is removed, the gyro ring will not be separated from the axis body, the structure is reliable, and meanwhile, the mounting is more convenient when the gyro ring is turned over and then connected to the axis body. In the present invention, the structural shapes or centers of gravity of upper and lower sides of the gyro ring are set to be different or the locking structure is disposed in a non-middle height position of the gyro ring, so that two gyros mounted before and after the direction of the gyro ring is turned over are obviously different in shapes and functions. The present invention is skillful in design and reliable in structure, and can diversify the game mode, so that it is extremely entertaining during playing, and can be widely applied in various fields of gyros.

The present invention is further described through the following accompanying drawings.

DETAILED DESCRIPTION OF THE PREFERRED EMBODIMENTS

Figure 1:
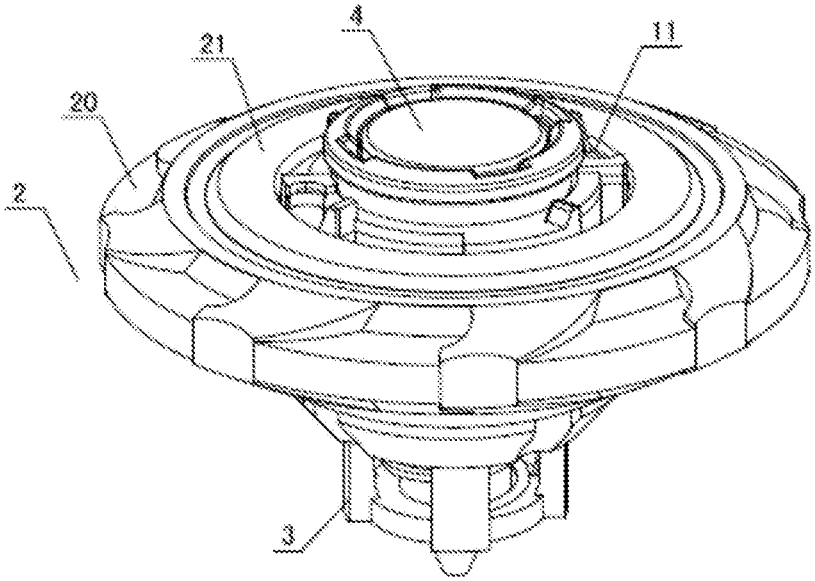
FIG. 1 is a schematic structural diagram of Embodiment 1 according to the present invention.
Figure 2:
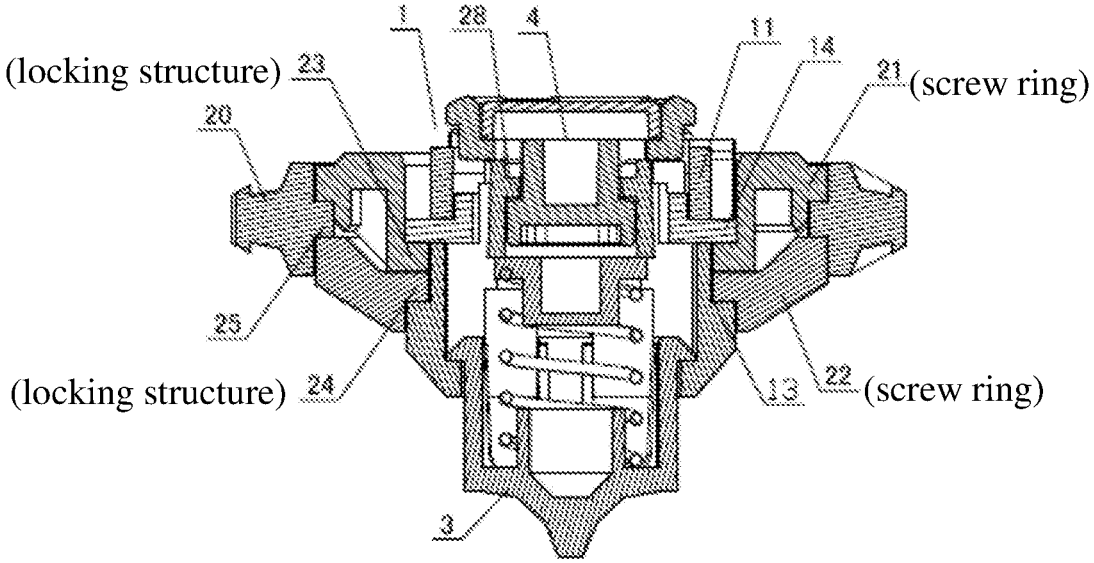
FIG. 2 is a schematic sectional structural diagram of FIG. 1.
Figure 3:
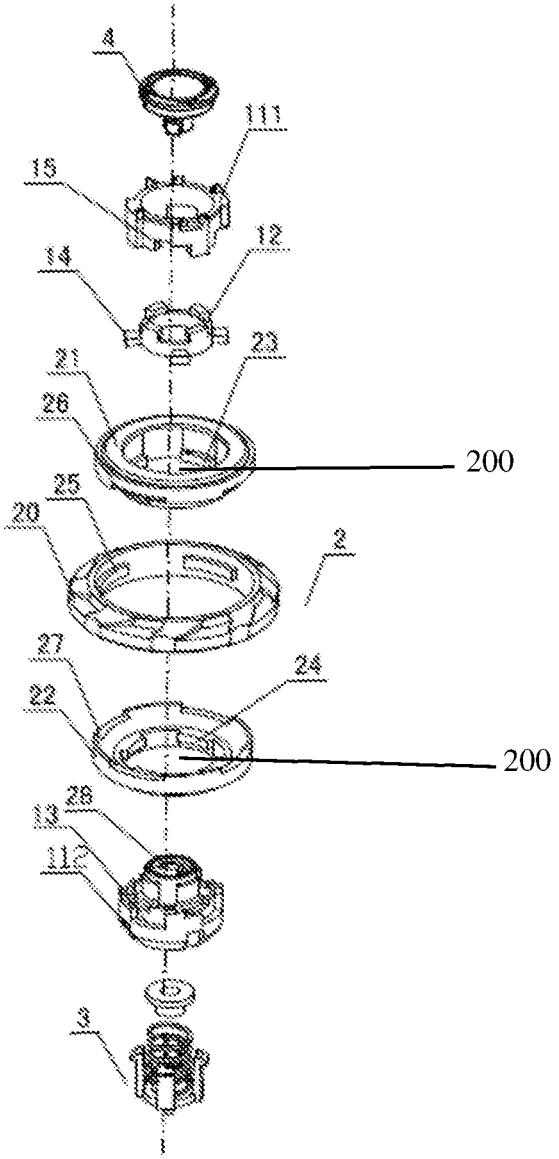
FIG. 3 is a schematic structural diagram of assembling of FIG. 1.
Figure 4:
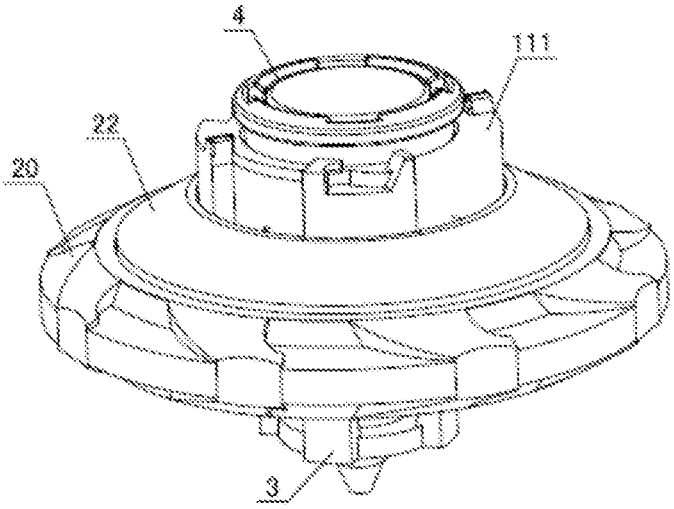
FIG. 4 is a schematic structural diagram of mounting a gyro ring in FIG. 1 by turning over the gyro ring.
Figure 5:
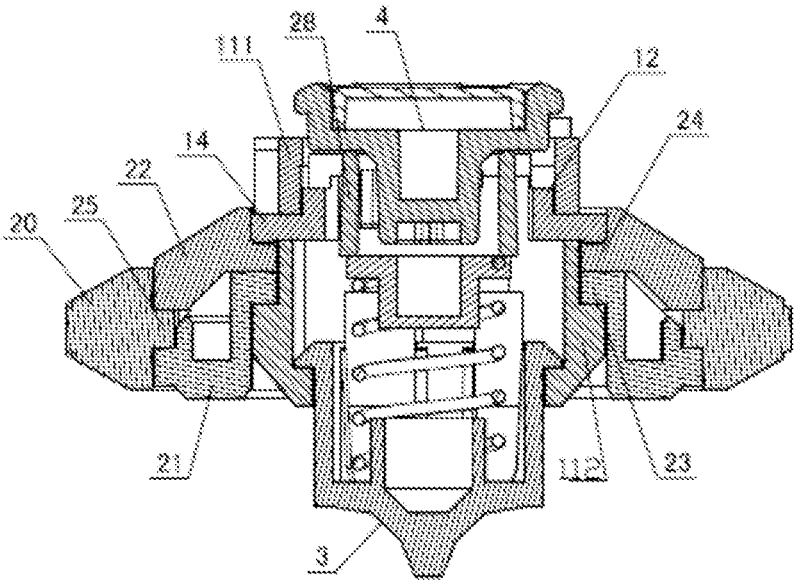
FIG. 5 is a schematic sectional structural diagram of FIG. 4.
Figure 6:
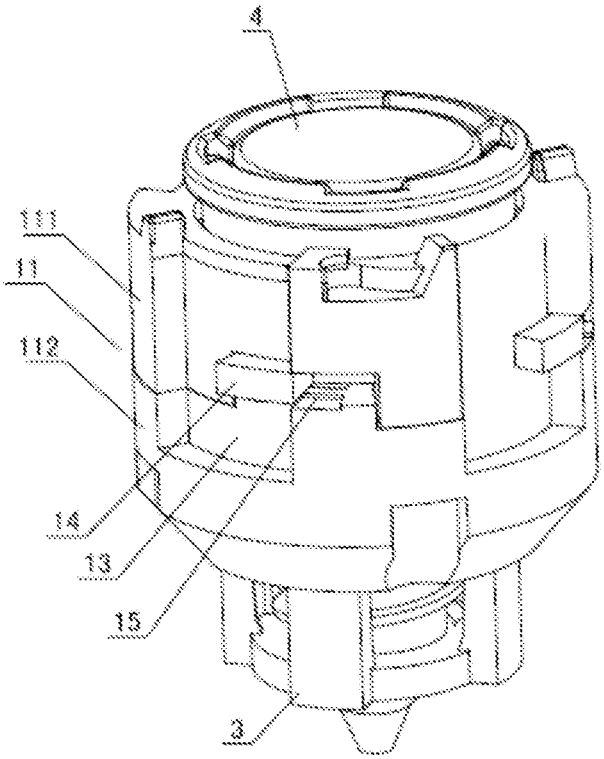
FIG. 6 is a schematic structural diagram of an axis body provided with a tip according to the present invention.

As shown in FIG. 1 to FIG. 6, a toy gyro having a gyro ring that can be assembled at both sides according to the present invention includes an axis body 1, and a gyro ring 2, a tip 3 and a cover 4 that are disposed on the axis body 1. In order that the playing mode of the gyro is more diversified, a direction of mounting the gyro ring 2 on the axis body 1 may be turned over vertically, in other words, the gyro ring 2 may be mounted on the axis body 1 with the upper side (the front side) facing upwards, or the gyro ring 2 may be mounted on the axis body 1 with the lower side (the reverse side) facing upwards, so that by turning over vertical orientations of the gyro ring 2 on the axis body 1, gyros having different shapes or different heights of center of gravity may be formed. During playing of the present invention, gyros having different shapes or having different heights of center of gravity may be formed by assembling of the gyro ring 2 on the axis body 1 in different directions, for example, when the center of gravity is low, the gyro has a strong endurance; and when the center of gravity is high, the gyro can perform top attack, and therefore, embodied functions are different, so that a user can select a different manner according to a characteristic of a gyro of an opponent, the game mode is more diversified, thereby effectively solving the problems of the conventional gyro such as single structure and game mode and little interestingness. In order that the present invention can form gyros having obviously different shapes and centers of gravity after the gyro ring 2 is turned over, the structural shapes or center of gravity settings of the upper and lower sides of the gyro ring 2 are different. Moreover, in order that the gyro ring 2 is still reliably combined with the axis body 1 without separating after the cover of the gyro ring 2 is removed, so as to be convenient for turnover and mounting of the gyro ring 2 during playing, and the screw ring is provided with the locking structure connected to the axis body 1, and the gyro ring 2 is reliably connected to the axis body 1 by means of the locking structure. Meanwhile, the locking structure may be disposed at a middle height position of the gyro ring 2, and may also be disposed at a non-middle height position. Especially, when the structural shapes or center of gravity settings of the upper and lower sides of the gyro are the same, the locking structure at the non-middle height position may be connected with the axis body 1 so as to form a gyro having a different height of center of gravity after turnover. This is because the variation of the height of the center of gravity of the gyro is mainly influenced by: first, the height of design positions of a connection structure (locking structure) on the gyro ring; second, different centers of gravity of two sides due to structural differences between upper and lower sides of the gyro ring, so that the gyro formed after the gyro ring direction is turned over has a different overall shape and overall center of gravity from the original gyro. In order that the gyro ring 2 has a greater rotational inertia and that it is more convenient to closely fit and assemble the gyro ring and the axis body 1, the gyro ring 2 includes a circular attack ring 20 having a through hole in the middle, and a screw ring disposed fitting the through hole of the attack ring 20 and used for implementing reliable connection of the attack ring 20 and the axis body 1. The attack ring 20 is made of metal, and the screw ring is made of non-metallic material, such as plastomer or plastics. There is a circular hole in the middle of the attack ring 20, without any structure such as an integrally disposed connection hole and assistant radial ribs connected to the connection hole, so that the material and processing process of the attack ring is reduced, and more development space is left for the gyro; moreover, the major center of gravity of the attack ring having a large weight lies in the outer part, so the rotational inertia is large. In addition, the locking structure in the screw ring is directly used to lock the gyro ring to the axis body 1, so that when the cover is removed, the gyro ring 2 is not separated from the axis body 1, and therefore, the gyro may be assembled conveniently. Further, in order to form gyros having different shapes and centers of gravity after the gyro ring 2 of the present invention is turned over, and in order that the appearance is more beautiful and the structure is more reliable, the screw ring includes upper and lower cover rings 21, 22 disposed fitting the through hole of the attack ring 20, the locking structure includes upper and lower flanges 23, 24 correspondingly disposed on inner walls of the upper and lower cover rings 21, 22; when the axis body 1 is sleeved in ring holes 200 of the upper and lower cover rings 21, 22, the upper and lower cover rings 21, 22 implement the reliable connection with the axis body 1 by means of fitting and catching of the upper and lower flanges 23, 24 and a block structure disposed on the axis body 1. The upper and lower cover rings 21, 22 generally adopt covers having different shapes or center of gravity settings. In order to obtain a more aesthetic overall appearance, an inner end of the upper cover ring 21 is formed into a convergent structure, the upper flange 23 is located at an opening of the inner end, an outer end of the lower cover ring 22 is formed into a convergent structure, and the lower flange 24 is disposed at a position on a middle portion of an inner wall of the lower cover ring 22 near the upper flange 23. In order that the connection structure of the axis body 1 and the gyro ring 2 is more reliable, the axis body 1 includes an axis sleeve 11 and a clamp ring 12 rotatably disposed on the axis sleeve 11, the block structure comprises a recessed clamp slot 13 axially disposed on an outer wall of the axis sleeve 11 and used for the upper and lower flanges 23, 24 to slide in, and a pin 14 integrally disposed on the clamp ring 12 and extending out of the axis sleeve 12, the outer wall of the axis sleeve 11 is correspondingly provided with a guide slot 15 for the pin 14 to penetrate and rotate horizontally, when the upper and lower flanges 23, 24 of the screw ring slide into the clamp slot 13, the clamp ring 12 is rotated so that the pin 14 is rotated to be above or under the upper and lower flanges 23, 24, and therefore, the upper and lower flanges 23, 24 are reliably locked between the pin 14 and one end edge of the clamp slot 13 to implement the reliable connection of the gyro ring 2 and the axis body 1. For further convenient machining and mounting, the axis sleeve 11 includes an upper and a lower axis sleeve 111, 112 fitting each other, where an upper portion of the lower axis sleeve 112 is sleeved in the upper axis sleeve 111, the clamp ring 2 is rotatably disposed between the upper and lower axis sleeves 111, 112, the upper portion of the lower axis sleeve 111 may be fitted with a cover 4 disposed at an upper end thereof or a bottom of an elastic tip of another gyro, a protrusion 28 fitting and engaging with the lower portion of the cover 4 is disposed on an inner wall thereof, and the clamp slot 13 is disposed on an outer wall of the upper axis sleeve 111 or the lower axis sleeve 112. For ease of rotating the clamp ring 12, an upper end of the clamp ring 12 is further provided with a tooth structure that can be used fitting an assembling tool. When the clamp slot 13 is disposed on the lower axis sleeve 112, as the upper and lower flanges 23, 24 of the screw ring slide into the clamp slot 13, the clamp ring 12 may be rotated by means of the assembling tool so that the pin 14 is rotated to be above the upper and lower flanges 23, 24, as shown in FIG. 2; on the contrary, when the clamp slot 13 is disposed on the upper axis sleeve 111, the pin 14 is rotated to be under the upper and lower flanges 23, 24. To enable more reliable connection of the upper and lower axis sleeves 111, 112, the two may further be reliably locked together by using a locking screw. In order that the attack ring 20 can be connected with the screw ring more reliably, a flange 25 is integrally disposed on an inner wall of the through hole of the attack ring 20, notches 26, 27 are correspondingly disposed on the upper and lower cover rings 21, 22 at positions corresponding to the flange 25, and the upper and lower cover rings 21, 22 are reliably positioned on the attack ring 20 by fitting of the notches 26, 27 and the flange 25. In order that it is convenient to joint two gyros into a gyro having a stronger aggressiveness, the gyro ring 2 is further provided with a clamping ring that can be rotationally clamped to a gyro ring of another gyro. A specific structure of the tip may be set randomly as desired. In this embodiment, the tip adopts an elastic tip. The present invention is skillful in design and reliable in structure, and can diversify the game mode, so that it is extremely entertaining during playing, and can be widely applied in various fields of gyros.

Although the present invention is described with reference to specific embodiments, the descriptions are not intended to limit the present invention. With reference to the descriptions of the present invention, other variations of the disclosed embodiments can be expected for a person skilled in the art, and such variations shall fall within the scope defined by the claims.

The invention claimed is:

1. A toy gyro having a gyro ring adapted to be assembled at both sides, comprising an axis body, and a gyro ring comprising a circular attack ring having a through hole in the middle and a screw ring having a through hole, the screw ring disposed within the through hole of the attack ring and configured for removeably connecting the attack ring to the axis body, wherein the axis body is arranged within the through hole of the screw ring, and wherein the screw ring includes a locking structure disposed thereon fitting and engaging with a portion of the axis body for removeably connecting the attack ring to the axis body, a tip and a cover disposed on the axis body, wherein a direction of mounting the gyro ring on the axis body may be turned over vertically, whereby turning over vertical orientations of the attack ring and screw ring on the axis body, provides gyros of different shapes or different heights of center of gravity wherein the screw ring comprises upper and lower cover rings disposed within the through hole of the attack ring, the locking structure comprising upper and lower flanges correspondingly disposed on inner walls of the upper and lower cover rings, the upper and lower cover rings implement the connection with the axis body by means of fitting and catching of the upper and lower flanges and a block structure disposed on the axis body.

2. The toy gyro having a gyro ring adapted to be assembled at both sides according to claim 1, wherein the gyro ring has upper and lower sides, and wherein structural shapes or center of gravity of the upper and lower sides of the gyro ring are different.

3. The toy gyro having a gyro ring adapted to be assembled at both sides according to claim 1, wherein the locking structure is arrangeable at a middle height position of the gyro ring and arrangeable at a non-middle height position.

4. The toy gyro having a gyro ring adapted to be assembled at both sides according to claim 1, wherein an inner end of the upper cover ring includes a convergent structure, the upper flange located at an opening of the inner end, an outer end of the lower cover ring includes a convergent structure, and the lower flange is disposed at a position on a middle portion of an inner wall of the lower cover ring near the upper flange.

5. The toy gyro having a gyro ring adapted to be assembled at both sides according to claim 1, wherein the axis body comprises an axis sleeve and a clamp ring rotatably disposed on the axis sleeve, the block structure comprising a recessed clamp slot axially disposed on an outer wall of the axis sleeve adapted for sliding receipt of the upper and lower flanges, and a pin integrally disposed on the clamp ring and extending out of the axis sleeve, the outer wall of the axis sleeve includes a guide slot for the pin to penetrate and rotate horizontally, wherein when the upper and lower flanges of the screw ring slide into the clamp slot, the clamp ring is rotated so that the pin is rotated to be above or under the upper and lower flanges, whereby the upper and lower flanges are locked between the pin and one end edge of the clamp slot connecting of the gyro ring and the axis body.

6. The toy gyro having a gyro ring adapted to be assembled at both sides according to claim 5, wherein the axis sleeve comprises upper and lower axis sleeves fitting each other, an upper portion of the lower axis sleeve is sleeved in the upper axis sleeve, the clamp ring is rotatably disposed between the upper and lower axis sleeves, and an upper end of the clamp ring includes a structure that can be used fitting an assembling tool.

7. The toy gyro having a gyro ring adapted to be assembled at both sides according to claim 6, wherein an upper portion of the lower axis sleeve is adapted to be fitted with a cover disposed on an upper end thereof or a bottom of an elastic tip of another gyro, and an inner wall thereof is provided with a protrusion fitting and engaging with a lower portion of the cover, wherein the clamp slot is disposed on an outer wall of the upper axis sleeve or lower axis sleeve.

8. The toy gyro having a gyro ring adapted to be assembled at both sides according to claim 1, wherein, a flange is integrally disposed on an inner wall of the through hole of the attack ring, notches are correspondingly disposed on the upper and lower cover rings at positions corresponding to the flange, and the upper and lower cover rings are positioned on the attack ring by fitting of the notches and the flange.

9. The toy gyro having a gyro ring adapted to be assembled at both sides according to claim 1, wherein the attack ring is made of metal, and the screw ring is made of plastomer or plastics.

10. The toy gyro having a gyro ring adapted to be assembled at both sides according to claim 3, wherein the gyro ring is further provided with a clamping ring adapted to be rotationally clamped to a gyro ring of another gyro.

* * * * *